United States Patent [19]

Rasche

[11] Patent Number: 4,687,236

[45] Date of Patent: Aug. 18, 1987

[54] LOCK WITH PIVOTABLE SLIDES

[76] Inventor: Dieter Rasche, Hauptstr. 21, 3052 Bad Nenndorf, Fed. Rep. of Germany

[21] Appl. No.: 786,686

[22] Filed: Oct. 11, 1985

[30] Foreign Application Priority Data

Oct. 16, 1984 [DE] Fed. Rep. of Germany ..... 3437806

[51] Int. Cl.[4] ..... E05C 19/02

[52] U.S. Cl. ..... 292/16; 24/645; 24/648; 24/654; 24/657; 70/127; 70/150; 292/18; 292/64; 292/71; 292/150; 292/207

[58] Field of Search ..... 292/5, 6, 14, 16, 18, 292/63, 64, 71, 150, 207; 70/109, 111, 142, 144, 125–127, 150, 107, 108, 110, 141, DIG. 79; 24/643, 645, 647, 648, 652, 654, 656, 657

[56] References Cited

U.S. PATENT DOCUMENTS

| | | | |
|---|---|---|---|
| 1,685,998 | 10/1928 | Hagstrom | 292/18 |
| 2,482,959 | 9/1949 | Anderson et al. | 292/63 |
| 2,702,719 | 2/1955 | Greene | 292/16 |
| 3,799,591 | 3/1974 | Taniyama | 292/71 |
| 3,951,442 | 4/1976 | Schlage | 292/71 |
| 4,361,939 | 12/1982 | Gelula et al. | 24/645 |

*Primary Examiner*—Robert L. Wolfe
*Assistant Examiner*—Lloyd A. Gall
*Attorney, Agent, or Firm*—Quaintance, Murphy & Presta

[57] ABSTRACT

The invention concerns a lock for doors or windows, with two latches each pivoting about a pivot pin being provided in the one component and of which the mutually facing ends in the locked position engage in mutually opposite directions an undercut surface of a locking bolt mounted on the other component, this locking bolt cross-sectionally being a wedge-shaped or conical tip by means of which the two latches can be forced apart against the opposing force of a spring, this lock being designed so that unauthorized forcible opening in the absence of a key is at least made appreciably more difficult.

The invention calls for the two latches being translationally mobile sliders located in one plane and of which the pivot pins are mounted approximately at the longitudinal center of the particular latch, the outer surfaces of the latches on the sides away from the locking bolt being a distance away from an inside housing wall of the lock, and a lock block displaceable along the latches each being mounted in the channel so formed, where this lock block has a length which is less than the distance between each pivot pin and the latch end pointing toward the center, and where for the locked position, the lock blocks are located in the area of the outwardly pointing latch ends.

14 Claims, 11 Drawing Figures

LOCK WITH PIVOTABLE SLIDES

BACKGROUND OF THE INVENTION

The invention concerns a lock, especially for doors or windows, wherein two latches each swinging about a pivot pin are mounted on one component, with their mutually facing ends engaging from opposite directions and from behind an undercut surface of a locking bolt mounted on the other component, the locking bolt having a cross-sectionally conical or wedge shaped tip by means of which the two latches can be forced apart against an opposing spring force.

In a known lock of this kind, the latches are pivotable about a common axis, both latches being in the shape of a double-arm lever at one end of which are mounted the latch segments engaging from the rear the undercut surface of the locking bolt and at the other end of which is mounted the spring compressing the latches.

This known design suffers from the drawback that the known lock can easily be opened from the outside provided that a tool be inserted between the two oppositely moving latches which then are spread apart. Once the latches are apart, the door or window is opened effortlessly.

SUMMARY OF THE INVENTION

It is therefore the object of the invention to so design a lock of the initially cited type that in the absence of a key, its unauthorized opening by force at least shall be made substantially more difficult.

This problem is solved by the invention in that the two latches are designed to be sliders which are translationally displaceable and located in a common plane, and with the axes of rotation arranged approximately at the longitudinal center of each latch, there being a gap, on that side away from the locking bolt, between the latches' outer surfaces and the inside housing wall of the lock, and a lock block displaceable in alignment with each latch is mounted in each channel so formed, the length of this block being less than the distance between the particular axis of rotation and the latch end pointing centrally, and in the locked position, the lock blocks are located in the vicinity of the outward pointing latch ends.

This design makes it possible that by inserting the locking bolt between the two latches, these latches are forced apart against the loading spring force and that after the excursion of the locking bolt or its associated segment they shall return into their initial position and engage from the rear the undercut surface of the locking bolt, with the locking bolt being now located in the channel between the latches' outside surfaces and the housing inside surface, with this channel holding the lock blocks.

Depending on the particular position of the lock blocks, the lock is solidly bolted in this position, or it may also be reopened by retracting the locking bolt. This is so because if the lock blocks are on the other side of the particular slider's pivot pin in the vicinity of the longitudinal outside of the lock, then this position of the lock blocks causes the particular outer end of the latches to be supported by the inside housing wall, whereby the latches cannot be pivoted about their pivot pins toward the outside. If the lock blocks move inward, the latch pivot pin is circumvented in each case, so that the support for the outer latch ends no longer is provided, and latch pivoting toward opening is now possible. The two lock blocks appropriately are inwardly displaceable by a key or the like so that the opening motion can be carried out.

It is especially advantageous that the translational motion and the rotation of the latches be made possible by a slot provided in each latch to pass through a pivot pin fixed to the housing, the slot extending in the longitudinal direction of the latch. Another possibility is to provide the inverse, namely two slots in mutually opposite housing surfaces and to rigidly join each pivot pin to the latches. By means of this arrangement of intermediate rings or flanges or the like, it is possible to have the latch surfaces spaced from the surrounding housing walls, whereby the friction incurred during latch motion is kept relatively low.

Appropriately the two lock blocks are provided with at least one continuous projection or the like pointing at the housing walls orthogonal to the latch pivot shafts. Guide grooves are provided in corresponding manner in the housing walls to receive the continuous projections, whereby for the case of pivot motion of the latches, the lock blocks retain their position with respect to the housing.

Again it is advantageous that the latches be bevelled with surfaces opening to the outside at their side pointing toward the locking bolt in order that the entry of this locking bolt be facilitated.

Any kind of drive means assuring an opposite motion of two parts can be used. Illustratively this motion can be implemented by using a pinion with gear racks mounted on both opposite sides of the pinion, or by an equilateral lever at both ends of which are linked the rods driving the lock blocks.

The spring-loading can be transmitted in each case by a partition loading the outer latch ends. This partition may be displaceable within mutually opposite guides of the lock housing, the inward motion being limited by the length of the guides so that the latches may swing out in a simple manner.

It is particularly advantageous that the lock be integrated vertically into the door leaf. Obviously the lock of the invention also may be installed if possible in the frame.

This means that unauthorized opening by inserting flexible tools or the like is rendered especially difficult because the latches must be pressed together in a direction which is orthogonal to the direction of insertion of the tool.

While theoretically the above described arrangement still allows forcing the latches apart against the spring force, practically, and for the aforementioed reasons, this can hardly be carried out.

Nevertheless a further design of the invention provides blocking the latches when in their closed position also against translational motion. To that end a locking pin or the like actuated together with the lock blocks and together with these snapping into the latches can be provided, which shall keep the latches in their translational closed position.

The lock blocks also may be displaced electromagnetically, for instance by loading a slider by two electromagnets acting in opposite directions in such a manner that the lock blocks are moved away from or toward each other. This load can be applied in the sense of the object of the application by means of a key.

BRIEF DESCRIPTION OF THE DRAWINGS

The invention is discussed in closer detail below in relation to illustrative embodiments shown in the drawings.

DESCRIPTION OF THE PREFERRED EMBODIMENTS

Figure 1:
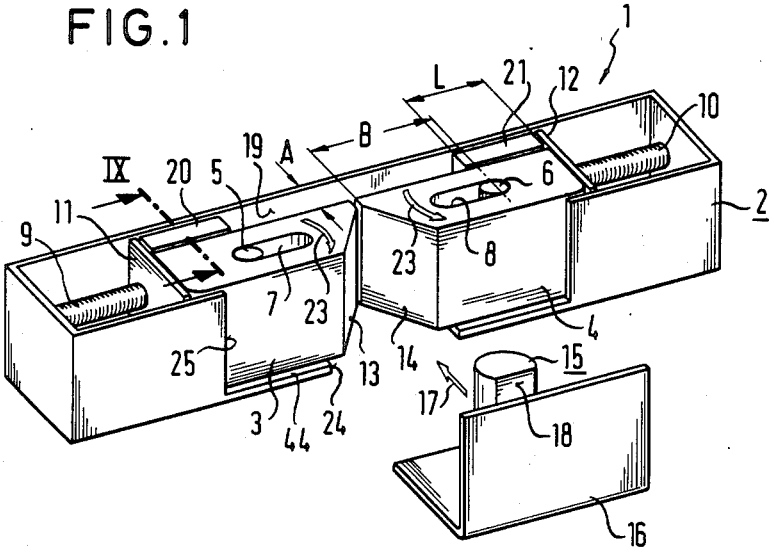
FIG. 1 is a perspective of an embodiment of the lock of the invention and with a housing wall, removed in this Figure, at the top.

FIG. 1 shows one embodiment of a lock 1 of the invention. For clarity, the lock is shown without the upper housing wall, that is, uncovered.

The lock comprises two latches 3 and 4 mounted in a parallelipedic housing 2 and located in a common plane, being pivotable about pivot pins 5 and 6 rigidly joined to the housing. The pivot pins 5 and 6 pass through slots 7 and 8 in the latches, whereby the latches 3 and 4 can also be translated within the range of these slots.

The latches 3 and 4 are pressed against each other by springs 9 and 10, and as regards the embodiment shown in FIG. 1, partitions 11 and 12 may be provided between the springs 9 and 10 and the latches 3 and 4.

The latches are provided with bevels 13 and 14 pointing in the direction of closing and opening outwardly to facilitate the entry of a locking bolt 15 mounted to the other component 16 of the lock and which can be inserted between the bevels 13 and 14 in the direction of the arrow 17.

The locking bolt 15 has an undercut surface 18 which is engaged in a manner described further below when the bolt has passed through the latches 3 and 4.

On the side away from the locking bolt, the outsides of the latches 3 and 4 are spaced a distance A from the housing wall 19 of the lock 1, with a lock block 20 and 21 displaceable in alignment in each case with the latches 3 and 4, the length L of the lock block being less than the distance between the particular pivot pin 5 and 6 and the latch end pointing toward the center.

Figure 6:
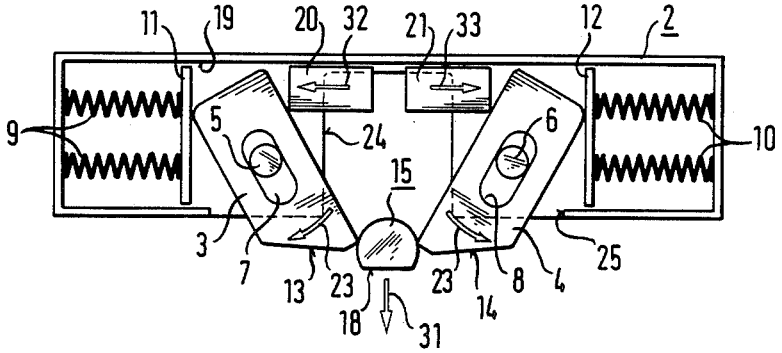

In this manner, when the lock blocks 20 and 21 are displaced inward, the latches can pivot outward in the direction of the arrows 23 without being hampered therein by the lock blocks (See FIG. 6).

To allow entry of the locking bolt, the lock housing 2 is provided with a lower housing slot or aperture 24 and a lateral housing slot or aperture 25 through which the latches can also be swung out as shown in FIG. 6.

Figure 2:
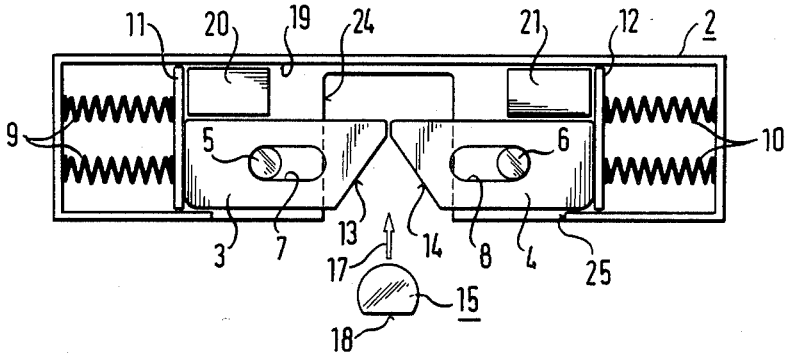
FIGS. 2 through 6 show the lock of FIG. 1 each time in top view for various operational positions of its individual components.

FIGS. 2 through 6 show various operational states of the lock of the invention. FIG. 2 shows the locked state of the lock, and in the embodiment of this Figure, two springs 9 and 10 are provided which act on the associated partitions 11 and 12.

In the locked state shown in FIG. 2, the lock blocks 20 and 21 each are forced outward, whereby the outer ends of the latches 3 and 4 rest on the lock blocks 20 and 21 and by means of these on the housing inside wall 19. Accordingly the latches 3 and 4 cannot pivot about the associated pivot pins 5 and 6 in the state shown by FIG. 2.

Figure 3:
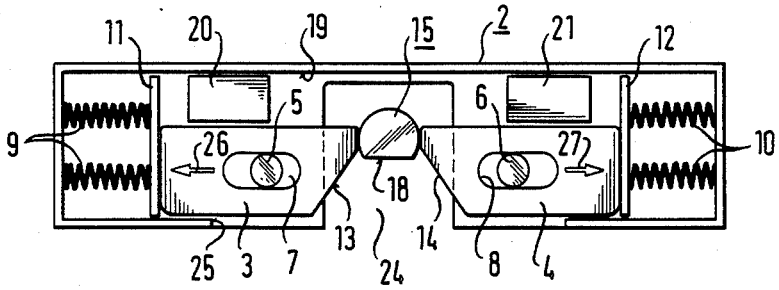

If next the locking bolt 15 is forced in the direction of the arrow 17 against the bevels 13 and 14, then as shown in FIG. 3 the latches 3 and 4 are forced outward in the direction of the arrows 26 and 27 and the springs 9 and 10 are compressed where compression springs are used, for instance in the embodiment shown. The lock blocks 20 and 21 remain in place, and therefore the latches also slide along the lock blocks 20 and 21.

In this position too the lock blocks 20 and 21 prevent the latches 3 and 4 from swinging outward.

Figure 4:
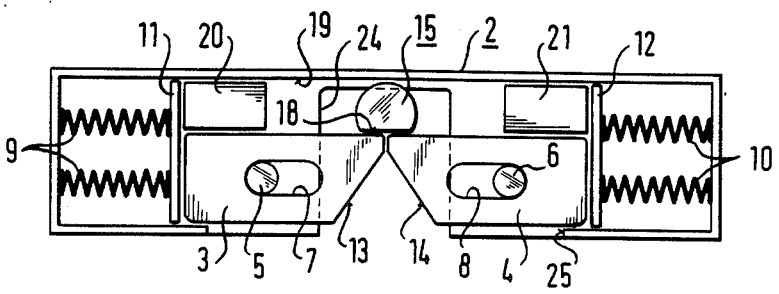

After further penetration of the locking bolt 15, the operational state shown in FIG. 4 is reached; the latches 3 and 4 move opposite the direction of the arrows 26 and 27 of FIG. 3 so as to be displaced inward again, whereby they engage from the rear the undercut surface 18 of the locking bolt 15. At the same time this operational state corresponds to the locked state of Fig. 2 wherein therefore the outer ends of the latches 3 and 4 are supported by the lock blocks 20 and 21.

Accordingly as regards the position of the lock blocks 20 and 21 in FIGS. 2 through 4, the door can be closed, but not reopened. If the lock of the invention were installed in the door body or in the door frame, as already discussed, perpendicular to same, then the unauthorized opening of such a door is hindered appreciably because the two latches must be spread apart against the direction of insertion of a tool. As a rule it will be enough that the two latches be held in their closed position merely by the forces from springs 9 and 10.

Figure 5:
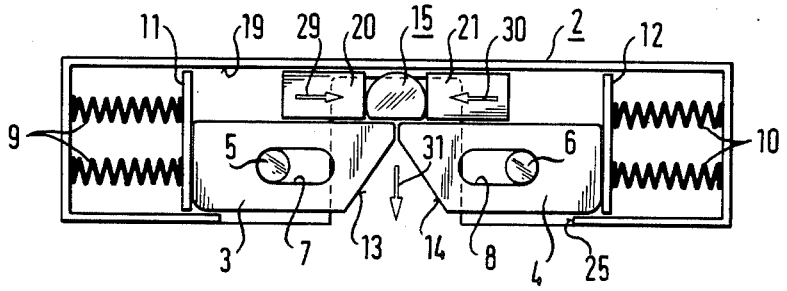

FIG. 5 shows an operational state for which the closed position is eliminated. For that end the two lock blocks 20 and 21 were displaced inward in the direction of the arrows 29 and 30, whereby their outer ends are located outside the longitudinal position of the pivot pins 5 and 6. As a result the outer ends of the latches 3 and 4 are released and now are capable of rotating about the pins 5 and 6 if by means of the locking bolt 15 a pressure is exerted in the direction of the arrow 31 on the central ends of the latches 3 and 4.

This swing motion in the direction of the arrows 23 about the pivot pins 5 and 6 is shown in FIG. 6. The locking bolt 15 accordingly pivots the latches 3 and 4 in the manner shown in FIG. 6 to the outside, and simultaneously can pass to the outside through their central ends.

To move the latches 3 and 4 back into their locked position as shown by FIG. 2, the lock blocks 20 and 21 are displaced oppositely, that is in the directions of the arrows 32 and 33, thereby impacting the rear ends of the latches 3 and 4 to drive them into the locked position of FIG. 2. When in this position, the door or window can be closed again by inserting the locking bolt 15 in the manner already described.

Figure 7:
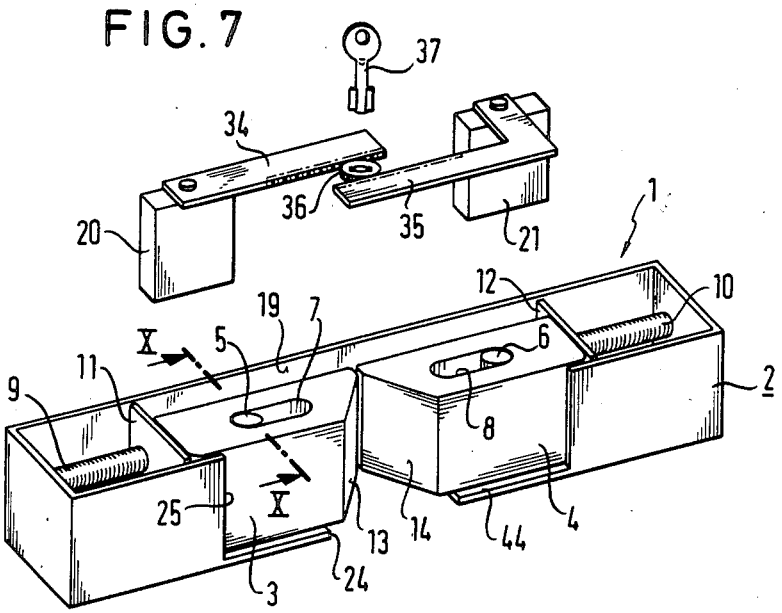
FIG. 7 is a view similar to FIG. 6, showing an embodiment for displacing the lock blocks.

FIG. 7 is a perspective similar to FIG. 1 where the lock blocks 20 and 21 are shown removed for greater clarity. FIG. 7 shows an embodiment for actuating the lock blocks. In this embodiment mode, gear racks 34 and 35 are connected with the lock blocks 20 and 21, the teeth facing each other and a pinion 36 being mounted between them.

Therefore a rotation of the pinion 36 causes simultaneous driving of both gear racks, whereby and depending on the direction of rotation, the lock blocks 20 and 21 are moved toward or away from each other. As the actuation of the lock blocks constitutes the locking proper, accesss to the pinion can be made safe by a key 37, whereby the pinion can be rotated only using the key. The arrangement of FIG. 7 furthermore offers the advantage of being widely self-locking.

Figure 8:
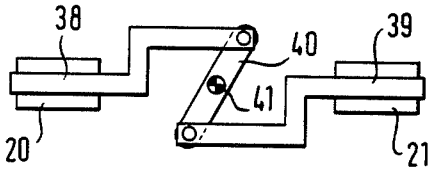
FIG. 8 is a top view of another embodiment for displacing the lock blocks.

FIG. 8 is a top view of another embodiment for actuating the lock blocks 20 and 21. In this embodiment the lock blocks 20 and 21 are fastened to bars 38 and 39 of which the free ends are linked to an equilateral lever 40 pivoting about an axis 41. In this embodiment also the lock blocks 20 and 21 are displaced toward or away from one another depending on the direction of rotation of the lever 40.

Figure 9:
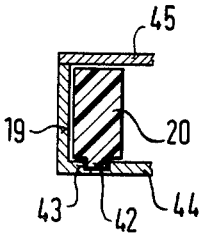
FIG. 9 is the section IX—IX of FIG. 1 for a special embodiment of a lock block.

FIG. 9 is the section IX—IX of FIG. 1 and shows an embodiment mode of the lock blocks 20 and 21 to the effect that for instance for the case of the latches 3 and 4 swung out as in FIG. 6, the lock blocks cannot change their position. For that purpose the lock blocks of FIG. 9 are provided with at least one continuous projection 42 engaging a guide groove 43 of the associated housing wall along the latches. In the embodiment shown, the guide groove 43 is in the lower housing cover 44 of FIGS. 1 and 7, that is this cover is orthogonal to the pivot pins 5 and 6. Corresponding grooves also can be provided in the upper housing cover 45 where allowed by the described drive-means end.

Figure 10:
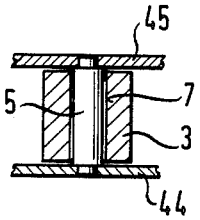
FIG. 10 is the section X—X of FIG. 7 and shows a possible storage of the latches.

FIG. 10 is the section X—X of FIG. 7 and has the embodiment of all previously shown Figures where the pin 5 is rigidly joined to the housing covers 44 and 45 while a slot 7 is present in the sectioned latch 3.

Figure 11:
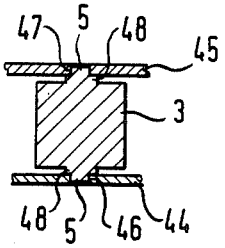
FIG. 11 is a section similar to FIG. 10 for another embodiment.

FIG. 11 shows the reverse case for which slots 46 and 47 parallel to the housing wall 19 are provided in the upper and lower housing covers 45 and 44, with the pivot pin 5 being part of the latch 3, that is rigidly joined to it.

To lessen the friction between the surfaces of the latches 3 and 4 and the surrounding housing walls, spacer rings can be provided on the pivot pins, or also, as shown by FIG. 11, offsets 48 keeping the latches a distance from the enclosing housing walls.

I claim:

1. A lock, in particular for doors or windows, comprising:

a housing having a base, a front wall, a rear wall, a first side wall and a second side wall;

a first aperture in the middle of said base;

a second aperture in the middle of said front wall having a width greater than said first aperture;

first and second vertical pivot pins mounted on said base between said first aperture and said second aperture;

a first translationally displaceable slider latch having a first slot therein adapted to be mounted on said first pivot pin and having a first end;

a second translationally displaceable slider latch having a second slot therein adapted to be mounted on said second pivot pin and having a second end, said ends mutually facing one another;

a first displaceable lock block located between said first latch and said rear wall;

a second displaceable lock block located between said second latch and said rear wall;

first spring biasing means mounted between said first side wall and said first lock block and said first latch;

second spring biasing means mounted between said second side wall and said second lock block and said second latch; and a closing bolt adapted to enter said apertures having an undercut surface adapted to engage said latches in a closed position.

2. The lock of claim 1, wherein said lock blocks have means for longitudinally displacing them to and from said side walls.

3. The lock of claim 2, wherein said means for longitudinally displacing includes a key.

4. The lock of claim 1, wherein spacer rings are mounted on the ends of said pivot pins (5,6) which maintain said latches a distance from said walls.

5. The lock of claim 1, wherein said lock blocks (20, 21) are provided with at least one continuous projection (42) pointing at said housing wall orthogonal to said pivot pins, said continuous projections (42) extending along said latches (3, 4) and entering guide grooves (43) in said walls.

6. The lock of claim 1, wherein said latches (3, 4) are provided at their side facing said locking bolt (15) with outwardly opening bevels (13, 14).

7. The lock of claim 1, wherein said lock blocks (20, 21) have drive means for displacement effecting an opposite motion.

8. The lock of claim 7, wherein said drive means consists of two mutually opposite gear racks (34, 35) between which is mounted a pinion (36), the free ends of the gear racks (34, 35) being connected to said lock blocks (20, 21).

9. The lock of claim 7, wherein said lock blocks (20, 21) are mounted to bars (38, 39) having free ends linked to the ends of an equilateral lever (40).

10. The lock of claim 9, wherein said drive means are actuated by means of a key.

11. The lock of claim 1, wherein said spring biasing means comprise springs (9, 10), a partition (11, 12) in turn loading the outer ends of said latches (3, 4).

12. The lock of claim 1, wherein said lock is installed vertically in a door leaf.

13. The lock of claim 1, wherein said lock is installed vertically in a door frame.

14. The lock of claim 1, wherein said latches (3, 4) are locked in a translational direction in their locked position.

* * * * *